United States Patent [19]

Morrell

[11] 4,161,441

[45] * Jul. 17, 1979

[54] PROCESS FOR THE PRODUCTION OF DISTILLATE FUELS FROM OIL SHALES AND BY-PRODUCT THEREFROM

[76] Inventor: Jacque C. Morrell, 4501 Conn. Ave. NW., Washington, D.C. 20008

[ * ] Notice: The portion of the term of this patent subsequent to May 4, 1993, has been disclaimed.

[21] Appl. No.: 847,832

[22] Filed: Oct. 31, 1977

Related U.S. Application Data

[63] Continuation of Ser. No. 679,315, Apr. 23, 1976, abandoned.

[51] Int. Cl.[2] ..... C10G 1/02

[52] U.S. Cl. ..... 208/11 R; 202/114; 202/120; 202/124

[58] Field of Search ..... 208/11 R

[56] References Cited

U.S. PATENT DOCUMENTS

| | | | |
|---|---|---|---|
| 3,691,056 | 9/1972 | Barney et al. | 208/11 R |
| 3,925,190 | 12/1975 | Whitcombe et al. | 208/11 R |
| 3,954,597 | 5/1976 | Morrell | 208/11 R |

*Primary Examiner*—Herbert Levine

*Attorney, Agent, or Firm*—Larson, Taylor and Hinds

[57] ABSTRACT

A continuous process for removing a substantial amount of the water present in oil shale prior to retorting the same to facillitate the rate of recovery of the oil therefrom in the retorting step of the process and to substantially increase the capacity of the latter step in the process and improve the overall efficiency thereof; which comprises subjecting the said oil shale in subdivided form to indirect heat treatment with hot combustion gases in a partial dehydration step under relatively milder temperature conditions than that of the retort, collecting the vapors and gases from the partial dehydration step, in the temperature range from the prevailing temperature up to about 550° F. to about 650° F., and for a sufficient time to remove substantial to major amounts of free and combined water from the oil shale accompanied by considerable amounts of oil distillate and thereafter passing the heated partially dehydrated oil shale to the retorting step for further indirect heat treatment in the approximate range of about 850° F. to about 1000° F., fractionating the vapors from the retorting step wherein there is removed a light overhead product comprising vapors of low boiling hydrocarbons, water, hydrocarbon gases and ammonia and wherein the heavier conversion oil products from the oil shale are condensed and separated is a liquid for further treatment and use.

4 Claims, 5 Drawing Figures

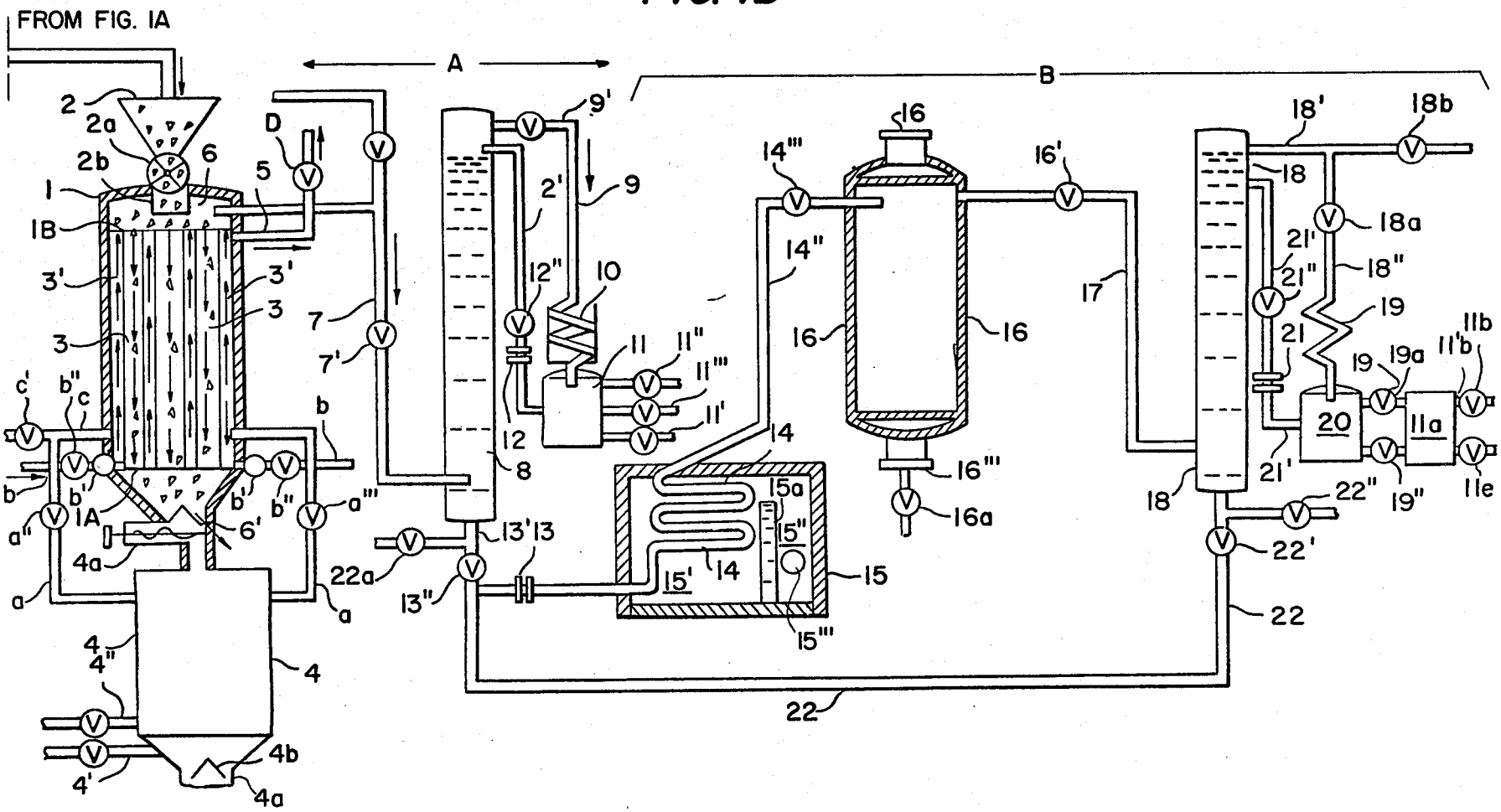
FIG. IB

PROCESS FOR THE PRODUCTION OF DISTILLATE FUELS FROM OIL SHALES AND BY-PRODUCT THEREFROM

This is a continuation, of application Ser. No. 679,315 filed Apr. 23, 1976 now abandoned.

BACKGROUND OF THE INVENTION

The present invention is an improvement of that described in Ser. No. 455,074 filed 3/27/74 now U.S. Pat. No. 3,954,597 mainly to improve the capacity of the retort section of the process as well as the balance in this respect with the process as a whole. In this sense, the latter improvement is a new and novel one in the art of retorting generally.

DESCRIPTION OF THE PRIOR ART

The prior art as a whole is fully described in the parent case. The prior art regarding oil shales relates mainly to the design and operation of oil shale retorts in Scotland and France and more recently in Australia as well as some lesser operations in other countries. The above foreign experience goes back for more than a century and while a number of improvements have been made mainly in retort design, there is little basis of comparison between the prior art of the past with the requirements of the future oil shale industry in the United States. The reason for this is because of the very limited objectives of the past both with regard to type and variety of products and uses of the same as well as the required capacities demanded. To cite the Scottish experience, which is the best, particularly from the view point of plant design, their objectives were to make maximum yield of both ammonia as well as refined oil products (including lubricating oils, kerosene and waxes). These objectives seriously limited capacities of the retorts, and the results with respect to the latter were far below requirements for projected U.S. products and practices. Comparison of results because of the era and completely different present objectives as indicated above, cannot be made. Development including some worthy research in the subject, generally in the United States, over the past 50 years have been limited with regard to production mainly to pilot plant retorts of a variety of designs, the merits of most of which remain to be proven. No unitary and continuous process comparable to that shown herein has been disclosed in the prior art.

SUMMARY OF THE INVENTION

The abstract of the disclosure above is a brief summary of the invention which does not however describe the necessary details to show flexibility and continuity over long periods demanded from the process as is shown below. It does, however, outline the basic principles of the invention as disclosed in sections A', A and B of FIG. 1 which represent respectively the preheating, retorting and cracking sections of the process of the invention; and when read in the light of the more detailed FIGS. 1*a* and 1*b* of the parent application which include additional features of important elements in connection with both sections A and B. It also refers to alternative retort features in addition to designs shown later of FIGS. 2, 3 and 3A intended to remedy the capacity aspects of the oil shale retorts of the prior art when applied to projected United States requirements with respect to types and quantities of products for modern needs. This includes equipment for mass production to which the invention is directed both as to principal products (referred to in the title) as well as additional improvements regarding the capacity and thruputs to meet the aforesaid demands: with maximum economy and simplicity of operation consistent with the tremendously important objectives of national security and independence.

PREFERRED EMBODIMENTS

FIG. 1 in essence is a flow sheet which embodies the general principles of the process, but rot all the necessary details. A selection of the elements of the overall process retort for section A could be made from two classes: (a) the vertical tubular type illustrated in FIG. 1 or (b) the vertical type (in fire brick or ceramic setting) illustrated in FIG. 2. (2) The horizontal rotary type of retort illustrated in FIGS. 3 and 3A. The other figures shown in the parent case and not shown here are desirable, but not necessary to illustrate the improvement shown herein. They still remain important to elaborate the details of the function of FIG. 1 as shown in the parent case as well as herein.

It is particularly noted that FIG. 1 of the present application essentially differs from that of the parent case in that section A' is added (and precedes the other sections) in order that large or major portion of water is removed from the oil shale prior to retorting for the main purpose increasing the capacity of the retort section A as well as other benefits.

BRIEF DESCRIPTION OF THE DRAWINGS

The drawings are illustrated and discussed in connection with the numbers of the figures, which in turn are directed to various aspects of the process of my invention, and the equipment and means used in connection therewith. FIG. 1 section A' is the preheating and drying section of the process wherein the oil shale is preheated to remove a substantial and/or a major portion of the water present in the oil shale both in free or combined form by subjecting the same to elevated temperatures but lower than those maintained in the retort employing preferably waste hot gases from the retort in section A and the cracking section B furnaces to heat the oil shale so as to remove a major portion of the water. This takes place along with some low boiling hydrocarbon distillate and reduces the burden of water removal from the retort and at the same time the capacity of the retort is substantially increased. FIG. 1 section A depicts the fractionator and partial condenser which permits separation of an overhead product consisting of a light oil distillate comprising gasoline and water which are condensed and collected in a receiver; as well as ammonia and hydrocarbon gases which are recovered. The major heavier oil product collects in the bottom of the fractionator and is pumped while hot to the cracking section of the process for conversion to gasoline and heavier oil distillates. Section A also includes a gas producer which is part of and supplies fuel to the retort system and utilizes by-product solid fuel (including spent oil shale) to convert to producer gas.

Section B is the cracking section of FIG. 1 which together with section A consisting of the oil shale retort and the fractionator, etc. constitute a unitary and continuous process for the production of cracked or pressure distillate which contains the gasoline and various other oil distillate products of the process already referred to and from which the finished products may be obtained by a simple process of refining disclosed herein.

It is noted here that FIG. 1B of the parent case illustrates section B of FIG. 1 in greater detail to develop important features thereof not shown in the latter particularly the arrangement for switching the reaction chambers in which the cracking reaction continues and coke is accumulated until the chamber is switched to another chamber for "clean out" during the continuous operation of the process. Also shown is the flow of oil to be cracked from the fractionator 8 shown in greater detail.

It is noted that the various sections in FIG. 1, A', A and B, are inter-related as a unitary, continuous process to produce the desired results.

Figure 1A:
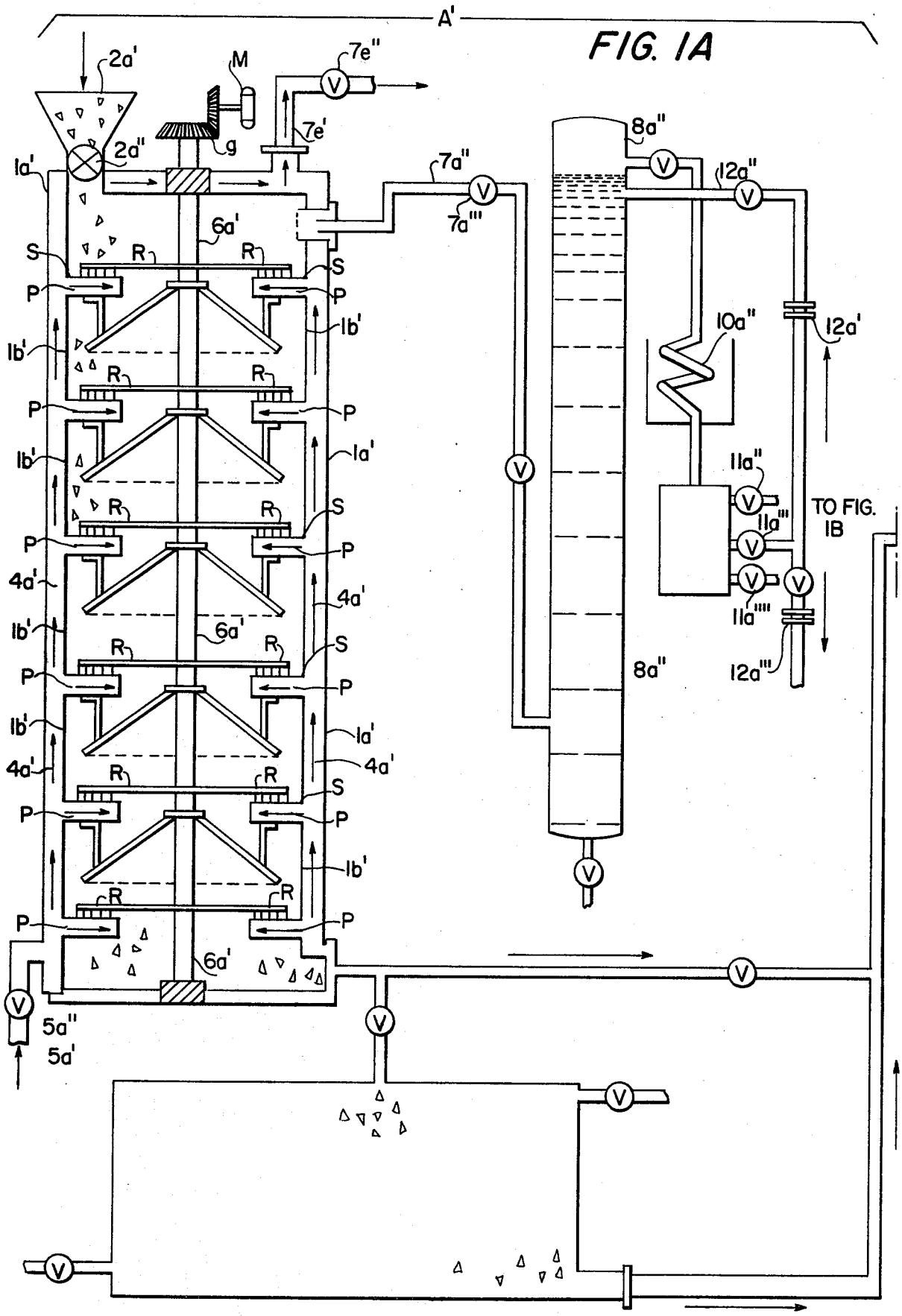
FIG. 1, essentially a flow sheet, is divided into sections A', A and B for convenience of description and discussion.
Figure 2:
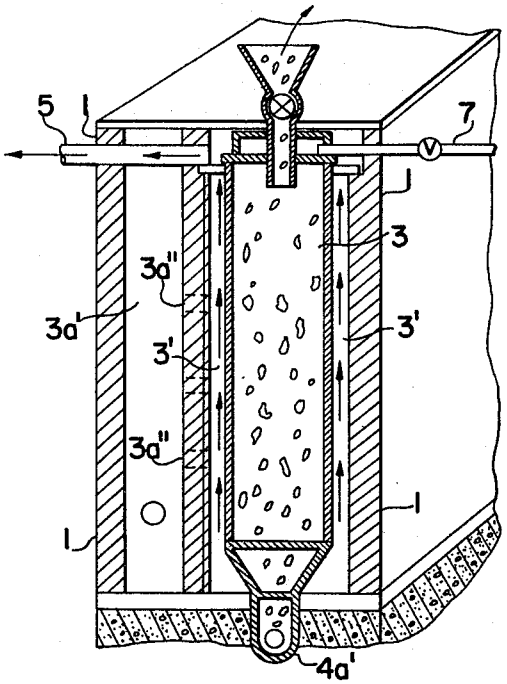

FIG. 2 relates to an alternate vertical tubular oil shale retort design with ceramic and/or fire brick setting preferably arranced as a battery of retorts to balance the cracking section B in FIG. 1.

Figure 3:
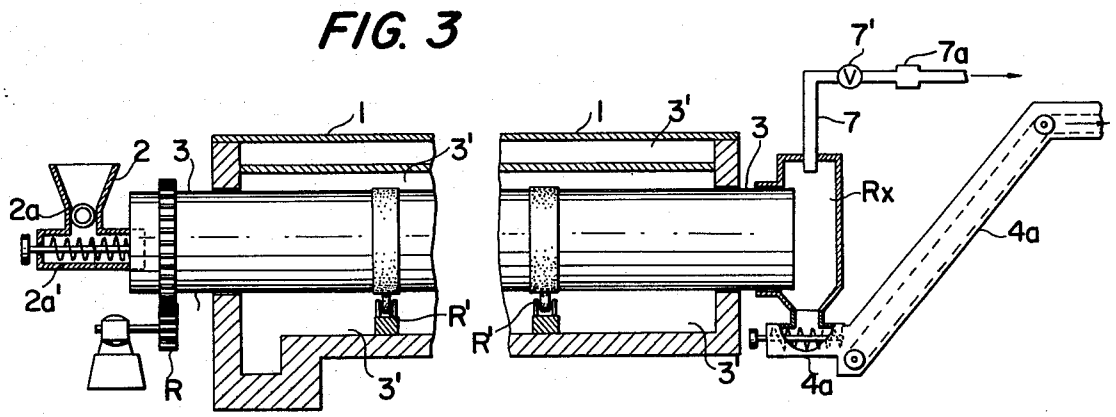
Figure 3A:
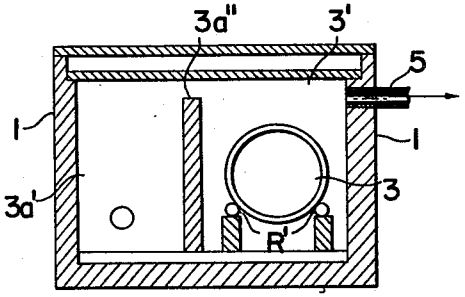

FIGS. 3 and 3A relate to the horizontal type of rotating retort for oil shald. Both of these types have special merit and are preferred types. Both are intended to be fully equipped with gas producers and other sources of by-product fuel and conveyors as shown in FIG. 1 and in the illustrations of the parent case.

The invention generally relates to the treatment of oil shales to provide oil products therefrom and more particularly relates to the process of treating and the said oil shales in a relatively economical, practical unitary and substantially continuous process to produce distillate oil including gasoline and fuels generally for air craft and automotive vehicles, and burning or heating oils suitable as domestic fuels, diesel oils, jet fuels and similar distillate oils suitable for various uses including, e.g., as raw materials for petrochemicals, etc., and as an alternate or substitute source for similar distillate products for petroleum. Moreover, it is intended to replace the latter and to meet the requirements thereof in all respects during critical periods such as the Middle East embargo aimed at a denial of necessary petroleum supplies; and in fact it will serve to replace petroleum products in the future when petroleum production and supply decreases; which is already a rapidly developing situation substantially below normal and in fact fails to meet minimum requirements; especially under embargo conditions.

With regard to the general subject of oil shale, from the mineralogical view point, an oil shale is basically a rock of sedimentary origin (normally from clays) which has the composition structure and formation of a shale generally (although alternatively considered by some as having a marl base). However, it does not yield oil on extraction with solvents. Oil shale is black or dark brown and when broken (generally with a conchoidal fracture), and contains a substance generally referred to as "kerogen" which on destructive distillation by heat treatment, at or somewhat above a dull red heat and higher produces an oil product generally similar to a hydrocarbon oil from petroleum, as well as hydrocarbon gas; and in addition, it produces nitrogen bases, and ammonia; the latter generally in aqueous solution, since water is also a product of the heat treatment.

Oil shales are found in very large amounts in several parts of the United States as well as in other locations throughout the world. The oil shale deposits in the Green River Formation in Colorado, Wyoming and Utah, etc., are generally of good quality and occur in vast quantities, and as shown below, oil shales occur in other parts of the United States, referred to below.

As a general guide the amounts of oil produced varies with the type of oil shale and conditions of treatment as well as other factors. As a further guide, a large percentage of the oil shale brought from the Green River Formation in Colorado, Wyoming and Utah and in some other parts of the United States may produce from 20 to 25 gallons (about one half barrel) per ton, and upward of 40 gallons per ton in some cases; although occasional beds in this formation may shown about 60 to 90 gallons per ton on a selective basis. Comparable yields of oil from lesser known deposits may be found in Nevada and California, and to some degree in Montana. Oil shale deposits are also found in the Midwest and the eastern part of the United States, e.g., Illinois, Kentucky, Ohio, New York, Pennsylvania, West Virginia and Tennessee; and oil shale in the same general formation (Devonian) yielding notable quantities of oil have been reported in Missouri, Kansas and Oklahoma. The latter are of lesser quality with respect to yield of oil than the Green River Formation, i.e., about 16 gallons per ton.

Recent estimates, reported in connection with the embargo crisis, state that the oil bearing shale in the Green River Formation which runs through Colorado, Wyoming and Utah contains an estimated 600 billion barrels of shale oil, enough to fill the country's needs at current consumption levels for about 100 years, and of course, to this may be added estimates of the very considerable Devonian Formation.

Reports on mining oil shale indicate the practicality of the room and pillar method in the Green River Formation with the added advantage over coal of greater structural strength of oil shale and less liability of gas formation and explosions. The Devonian formation is amenable to strip mining having definitely in mind the environmental problem and at the same time the solutions which have been successfully applied thereto. Water is available, but, in general, the time has arrived when its proper allocation must be considered on a national basis; and known technology such as recycling, etc. applied as required. The Colorado River rises in the Green River Formation and the need for fuel distillates is definitely of significant national importance to warrant a technically controlled allocation.

It may be noted in connection with the present improvement of my invention that a typical oil shale, e.g., from the Green River Formation (Colorado, Wyoming and Utah) which may produce from 20 to 40 gallons of oil per ton (and in some cases as much as 90 gallons) may also contain a considerable amount of water, e.g., up to one-quarter to one-third of the oil. The oil is produced in heat treatment of the kerogen (the parent substance). The latter under the microscope has a structure indicating its derivation from plant life. The water produced on retorting evidentally traces back to the underwater formation of the oil shale. It is well known that conversion of kerogen to oil by high temperature treatment is a chemical reaction; but it is not so well known that the water appears likewise to be "chemically or otherwise bound" because of the abnormally long time and high temperature required to release the water.

Before proceeding to a detailed account of FIG. 1 (which embodies the new section A'), in addition to sections A and B of the parent application) the following is a brief description of some of the underlying principles which I have discovered relative to the present improvement.

Over a range of increasing temperatures, I have found that the water in oil shale does not exhibit its normal behavior as a simple compound, e.g., boiling at a constant temperature. Moreover, its rate of release is considerably slower and continuing to occur at much higher temperatures than "free water", but of course, after release retains its normal properties. It does, however, evolve at a much more rapid rate than the production and/or release of the oil-which incidentally is a mixture that has a wide range of boiling points.

Comparison in one set of tests showed that in the above connection at a maximum temperature of 860° F. six hours were required to complete the distillation, or release on retorting: however, at a maximum temperature of 985° F. the retort distillation or release of all the water and oil (at different rates) was completed in two hours. This is of significance in connection with the present invention in retorting oil shale in the retort section A of the process expecially from the viewpoint of capacity.

The following data in the above connection is significant with respect to the preliminary drying treatment of the oil shale. In a series of tests on the relative rates of removal of water it was shown that in the first two hours or retorting at a maximum temperature of drying about 600° F. more or less about 50% of the total water was removed whereas only about 20% of the extractable total oil was removed under the same conditions. During a three hour period at a maximum of about 700° F., 72% of the water was removed and only about one-third of the oil removed. The rate of water removal at these comparatively lower preretorting temperatures are thus seen to be much greater than oil removal.

From the evidence set forth above, it is concluded that a period of about two hours at about 600° F. (e.g., 550° to 650° F.) is a suitable drying period to remove about one-half of the water present and at the same time, a light hydrocarbon distillate amounting to about 20% of the total hydrocarbon distillage, and as noted above in this connection, increasing the temperature to about 700° F. over a period of three hours 72% of the water is removed with about one-third of the oil. It is also noted in connection with the above that the source of heat employed to heat (preferably indirectly) the dryer may be obtained from the hot stack gases from the retort or furnace of the cracking section which relieves uses of any fuel or additional costs. Using the above procedure as pretreatment removes a considerable burden from the retort, and thus increases its capacity by a very considerable amount. Moreover, by increasing the operating temperature of the retort from about 850° F. to 900° F., up to 950° F. to 1000° F. the above residence time in the retort is greatly reduced and the capacity increased accordingly. Furthermore by simultaneous increase in the heating surface by increasing the diameter of the horizontal retort from about 3 up to 4 to 6 feet and increasing the length from about 25 to 30 feet up to 50 to 60 feet results in a tremendous increase in the retort capacity over that contemplated or achieved in the past.

The effect of the use of the above procedures results in the elimination of cumbersom and/or costly procedures (which aside from embarrasing questions about plant and operating costs, and in this regard the practicality of the process); and instead solves a most important problem in connection with the industralization of oil shale commensurate with that required to replace the petropleum industry.

Referring to FIG. 1, which shows diagrammatically the main principles of the process presented for convenience of reference in the form of a flow chart divided into several sections, e.g., section A' pretreatment of the oil shale, section A, retort as well as the fractionator for separating the heavier shale oil fractions for further treatment in the cracking section (after separating the remaining water and light oil present); also with accompanying gas producer and heating system for the retort and means for disposing of the shale ash, section B the cracking system to convert the major portions of the heavier liquid products from the retorting system A, all of which are a part of a unitary and continuous process to be more fully described below.

With particular reference to section A' of FIG. 1, the oil shale is subdivided by crushing or otherwise breaking it into suitable sizes, e.g., from ¼ inch to 1 inch more or less. It is then introduced into the drying system which in general consists of means for applying indirect heat, preferably from hot waste gases, etc., (such as combustion gases en route to the stack, e.g., from the retort or furnace in the cracking section B of the system) to heat the oil shale and to remove a substantial portion of the water (together with dissolved ammonia contained therein, and usually together with some light hydrocarbon distillate) which are then condensed and collected. The partially dried oil shale is then led into the retort system to remove the remainder of the water and all of the remaining oil, including the heavier topped crude shale oil (collected from the bottom of the fractionator connected to the retort) which is then pumped while hot to the cracking section B of the continuous process described in my Application No. 455074 (also described herein) filed Mar. 27, 1974. It is noted therefore that section A' of the present invention while an integral part of the entire process has independent novelty and utility.

Referring to section A' of FIG. 1, the oil shale is subdivided by crushing, etc. to suitable sizes, e.g., from ¼ inch to 1 inch, more or less, and is fed into the dryer 1*a'* through hopper 2*a'* equipped with feed mechanism 2*a''* (which prevents the gases and vapors from escaping) and is introduced into the drying system 1*a'*. The latter as illustrated consists of an outer cylindrical shell (3*a'*) in spaced relationship with an inner element 3*a''* in general of cylindrical cross-section and smaller diameter than the outer shell to permit hot gases to pass in the space between the outer element 3*a'* and inner cylindrical element 4*a'*. The inner cylindrical element has circular depressions or paths p spaced at regular intervals (from top to bottom of the inner cylindrical element) of rectangular cross-section which forms hollow shelves s spaced at regular intervals within the inner cylindrical element 1*b'*. This permits the hot gases passing between the two cylindrical elements to enter the spaces between the upper element of the hollow shelf and the lower element thereof and to heat the crushed oil shale as it passes over the shelves s within the inner cylindrical element and to remove the major or a very considerable portion of the water contained in the oil shale descending from the shelf to the next lower one as set forth in the preliminary remarks pertaining thereto.

The hot combustion gases from the stacks in the overall process enter the drying system through pipe 5*a'* controlled by valve 5*a''* and through the passageway between the outer and inner cylindrical elements passing in and out and through the circular spaced paths p formed by the upper plate and the lower plate of the hollow shelves on top and bottom of the paths p and transmits the heat from the hot gases passing therethrough to the descending oil shale thereby removing the water, etc. contained there in. The water vapor, ammonia and hydrocarbon vapors pass through line *7a''* from which it passes to a standby fractionator 8*a''* and condenser 10*a''* with valve controls for draw-off or alternatively as found or practical or desirable the vapor may pass directly to fractionator 8 (lines not shown) condenser 10 and receiver 11*a''* as explained in connection with the operation of the retort. Draw-off lines from receiver and control valves to remove the products therefrom and recirculation and with drainal pumps 12*a'* and 12*a''* serve the same purpose in this system as in the corresponding retort system.

Reverting to the drying system, the decending oil shale passing over the heated shelves s is moved from one shelf to the next lower one, etc. by rotating rakes or scrapers r activated by motor m, gears g and shaft 6*a'* and which falls over and is guided by inverted cone-like elements which are supported by metal straps attached to the underside of the shelves. The cone-like element guides and controls the flow of the oil shale from one shelf to the next lower one.

The hot and partially dehydrated shale is removed from the dryer continuously and is fed preferably while still hot through the feed mechanism into the retort section A as described below. The hot gases after passing through the spaces between the inner and outer cylindrical elements and in the spaces and between the top and bottom of the shelves is passed through exit line *7e'* controlled by valve *7e''* and is exhausted to the stack.

It is expecially noted that while the pre-drying apparatus (and process therefore) described under section A' herein is preferred various other types of drying systems may be employed which will produce satisfactory results: for example a large rotary cylindrical dryer diameter (horizontal) eg. about six foot diameter and 40 to 50 foot long (operated at high capacity) under conditions previously described, in tandem with a horizontal rotary retort both under the high capacity temperature conditions already described herein, and other similar combinations may be employed.

With particular references to Section A of FIG. 1 relating to the retorting of the oil shale comprising the oil shale retort 1 so arranged in the interior that the shale which is fed in through hopper 2 the latter being equipped with feed mechanism 2*a* which permits the oil shale to pass into the retort while preventing the gases and vapor evolved in the retort from escaping. The oil shale which is previously crushed to suitable sizes of pieces, preferably from about ½ inch to 1 inch more or less. and utilizing the fines, e.g., down to ¼ inch and less for retorting. The retort may be arranged in a battery of several units as found convenient to meet production requirements and to maintain a balance between capacities of the retorts in section A and the cracking section B which is an integral part of the process and which will serve generally a number of retorts, e.g., in a battery. The oil shale posses from the top downward indicated by the heating tubes 3 as shown and is heated and decomposed by the hot gases passing around the outside of the heating tubes resulting from the combustion of fuel which may be, either or both, producer gas and cracked gases as a product or by-product of the process. The producer gas may be made from the spent shale, the ash from which may be used as fill in the mine and for various useful products.

The fuel passes from the gas producer 4 which in general employs by-product carbonaceous materials through lines a and a' controlled by valves a'' and a''' and passes into the retort to be burned in the annular spaces around the heating tubes in closely controlled coordination with air, employing, of course, the necessary safety and heat efficiency means. The air is supplied through lines b and b' controlled by valve b'' and b'''. Lines c and valve c' provide fuel gas when needed from other sources. The burning gases and hot gaseous products of combustion pass upward illustrated by arrows around the heating tubes containing the descending oil shale, (likewise illustrated), in countercurrent flow and out of contact with each other, to avoid mixing combustion gases with the oil vapors and product gases from the process, but in heat transfer relationship with each other. The hydrocarbon oil vapors and gases which are the desired product of the reaction procuded by the conversion of the major portion of the active oil froming substance in the oil shale (referred to as "kerogen", etc.) pass upwardly through the descending oil shale. The heating tubes of the retort (in the present case) may be considered as large diameter pipes or small individual retorts, and preferably made of heat and corrosion resistant alloy steel or cast iron fixed in the plates top (1B) and bottom (1A) which confine the hot combustion gases in the retort during their passage therethrough (and prevent their mixing with the oil vapors) in the spaces 3' around the heating tubes 3 and to line 5 controlled by valve D where it may be heat exchanged to partially dry the oil shale as described herein and to generate or to super-heat steam (or the heat otherwise used) before passing into the chimney or stack.

The hydrocarbon vapors and gases from the oil shale rising in the retort heating tubes pass into the space or compartment 6 into which the oil shale is introduced into the retort and then leaves compartment 6 and passes through line 7 controlled by valve 7' into fractionator and partial condenser 8 where it is separated. into light overhead fractions containing hydrocarbon oil vapors and gases as well as an aqueous fraction. It is noted here that there is still a considerable water content in the oil shale, which may be utilized where necessary, after recovery of ammonia contained therein. Also nitrogen bases are present in the overhead product. The vapors of the overhead fraction (consisting principally of a light oil and aqueous fractions) may be passed through line 9 controlled by valve 9' and through water cooled condenser 10; and the resulting liquid and uncondensible gases are then passed into receiver 11 from which the gases may be withdrawn through line and control valve 11'' and the liquid oil through line and control valve 11'''. The water may be removed through line and valve 11''''. Line 11'' on the receiver may be equipped with a fan or similar device which may be used as found necessary to create a slightly reduced pressure to induce the flow of gases. (The latter may prove expedient to assist in avoiding leaks within the retort.) The gases withdrawn from the receiver may be washed free of ammonia (with water) which may be recovered as such or as ammonium sulphate useful as fertilizer, etc. The liquids in the receiver comprise a heavier water layer which is withdrawn through line and valve 11'''. (It is noted that it is desirable to remove gases to a separator or receiver 11*a* which is shown also in connection with FIG. 1A, with suitable valve control, and from there to storage.) The light oil layer may be withdrawn through line and valve 11'''. Dissolved basic components in the water may be recovered. The light overhead distillate may be recovered and combined with the major distillate product of the process from section B before refining the latter, or refined separately as described below. A portion of the light distillate is recycled into the top of the fractionator to assist in controlling the degree of condensation in the fractionator, and the physical properties of the overhead distillate as well as that of the heavier oil condensate or reflux in the fractinator. The distillate from the receiver may be pumped through line and valve (12' and 12'') into the top of the fractionator 8 to accomplish this objective. It is noted in connection with FIG. 1 that the pressure in the retort in section A is substantially atmospheric whereas that in the following section B, described below, is high pressure throughout.

With regard to retort design relating to capacity (or throughout) of oil shale, heat transfer and operating questions generally such as charging the heating tubes, etc. FIG. 1*a* and FIG. 1*b* in section A (of the parent case) illustrate a basic design utilizing a multiplicity of heating tubes and distribution of the same, and another shows a single large heating tube. The full circle in 1*a* illustrates (when properly centered) a satisfactory design, the dotted circles illustrate an area from compromise of location. In both cases a separate circular element around the edge of the plate (with an approximate triangular cross-section or other device) may be fitted to promote downward movement of the oil shale into the heating tubes. FIG. 1*b* illustrates a large heating tube or in effect a large single tube retort with special top designed to promote flow of the oil shale (in effect a funnel shaped top) and arrangement for fitting the various elements together. This, of course, could be varied in relative sizes or diameters. It may be noted that in the case of this type of retort design, the setting or outer walls could very well be made of fire brick or suitable ceramic material for heating and flow of combustion gases and the metal flues fitted therein for the passage of the oil shale and upward passage of oil vapors and gases therein maintaining the general principle of keeping the latter separate from the combustion gases. In the event of special cases where there is need for a positive mechanism to move the oil shale charge into the flue a revolving metal rake suspended on a vertical shaft rotating on a bearing and supported by the underside of the feed hopper and geared to a motor outside the retort or other suitable arrangement to serve the purpose.

In addition to the above comments the following are to be noted in connection with retort design and operation control of the same. In order to avoid the tendency for the heated oil shale to stick to the inner sides of the retort as it passes downward (especially in the vertical tubular type of various sizes and arrangement as shown herein) the latter may be flared, by gradually increasing the diameter of the tube from about ¼ to ⅓ down from the top to the bottom to slope the inside of the retort somewhat outwardly (as shown in FIG. 1*c*).

Further, in order to control the throughput of the oil shale, the latter may rest upon a pair of toothed rolls, which are arranged mechanically to be rotated towards each other at a regulated rate to control the residence time and discharge rate of the oil shale passing through the retort. As an example in the case of the retort described in connection with FIG. 1, the toothed rolls are fitted into the bottom of the same, above the cone-shaped discharge valve 6' the latter being fitted with suitable mechanism to be raised and lowered and adjusted at will to meet operating requirements.

The toothed rolls or other means performing the same function are likewise equipped with suitable mechanism controlled from outside the retort to regulate the rate of discharge of the spent shale, and simultaneously, the time of heating the oil shale under the selected temperature conditions.

Reverting now to the heated oil from the retort section A of the process to the cracking section B thereof, also in FIG. 1, the heavier oil reflux or condensate from the bottom of the fractionator 8 is withdrawn through line 13' and valve 13'' from the latter by high pressure hot oil pump 13 and pumped at relatively high pressure into heating coil 14 (generally referred to as heating tubes) with return bends or elements which serve this purpose, (generally suitable threaded elements fitted with threaded plugs) which permit cleaning the heating tubes periodically.

The oil entering the heating or cracking tubes is raised to a cracking temperature, for example of about 850° to 950° F. Under a pressure of about 100 to 250 pounds. (The lower range conditions may vary considerably as shown in the examples given below where both the temperature and pressure may be considerably less in the low range, e.g., between 750° to 850° F. and the lower range of pressure between 100 and 150 pounds.) It is noted that the range of both temperatures and pressures are generally lower for shale oils, in comparable fractions than those from petroleum. The heating tubes which are generally made of alloy steel to prolong their life are located in a furnace setting 15 divided into two sections by partition 15*a* which permits hot gases to pass into the other section referred to as the heating and combustion section respectively 15' and 15''. The firing port is designated as 15'''. Heating may be done with gas using producer gas or cracked gas, or a mixture, and other available fuels as desired; generally obtained as a product (or by-product) of the process. The highly heated oil at cracking temperatures is passed through line 14'' controlled by valve 14 ''' and is discharged into cracking and coking, or reaction chamber 16 (likewise under pressure) which may be controlled by valve 16'. These chambers additionally facilitate storage of coke made in the process, and may be of the order of 10 feet diameter, and up to 40 or more in height. In order to maximize the yield of light oils, the process is operated on what is known as the non-residuum process by which is meant that in general no liquid residuum is withdrawn as a product from the chamber. Also that the heavy oil entering the chamber is cracked practically completely to coke as a residual product; and distillate fuels, as overhead products which may be refined into gasoline, domestic fuel or burning oil, diesel fuel, jet fuels and the like.

It is important to emphasize in order to maintain continuity of operation of the process from an economic view point and in general that in the present process with the oil shale as the primary charging stock in the retort; the operation of the cracking section B with a relatively heavy oil on a non-residuum basis producing coke as a residue (and specifically with the hot shale oil as the charge) would demand more than one reaction or cracking (and coking) chamber, e.g., at least two chambers and preferably three (with one as standby) for each battery of retorts). Although not shown in FIG. 1, it is to be understood that to maintain a balance, it is necessary to have standby chambers with valves and lines, etc. capable of being switched from one to the other as in FIG. 1B (of the parent case) which in any event is a practical and economic operating expedient. Moreover, in order to maintain continuity of operation of the process as a practical matter, two or more chambers should be used in each cracking section of the process, which it is emphasized is a unitary and continuous one from the charging of the oil shale into the retort to the recovery of the final distillate products in the receiver of the cracking section. The use of the terms "drying section", "retort section" and "cracking section" are for clarification in presentation only, since both parts of the system are inherently inseparable from each other and the remaining elements of the process. The primary oil distillate product collected in the receiver of section B needs only refining and distillation to produce the variety of marketable and useful products of type referred to herein.

With respect to continuity of operation in cracking section B, after filling a chamber with coke (and while the coke is being withdrawn from the full chamber, using any one of several proven methods described below), the alternate chamber is to be properly connected by the switching arrangement shown in FIG. 1B (of the parent case) to continue the operation. Cleaning of the alloy steel heating tubes (with special return bends or elements equipped with threaded plugs) is on a relatively much longer schedule and offers no special problme with respect to continuity. The cracking chambers may be equipped with manholes and covers 16'' and bottom 16''40 . Cleaning out the accumulated coke in one method is accomplished by suspending steel cables inside the chamber and removing the coke by pulling out the cable when full. Another method of removing the coke is to drill a large hole through the entire mass of coke, and removing the coke in sections by lowering a hydraulic device which cuts the coke as it advances and permits removal of the pieces. Both of these methods (as well as other methods) may be employed, at least three of which have been fully tested. Coke from the cracking of shale oil is a high BTU fuel as such with low ash and useful for producer gas and other purposes, e.g., as low ash carbon electrodes. As already mentioned in this connection, the process itself is self-sufficient as well as for other needs with respect to fuel requirements, i.e., producer gas from spent shale, retort gases, and gases and coke from cracking section B from the by-product fuel sources alone.

To continue the operation of the cracking section B of the process, vapors and/or gases from the reaction chamber pass through line 17 into dephlegmator 18 where it is separated into an overhead fraction consisting of mainly oil distillates referred to as pressure distillate, in the boiling range of a variety of distillate products from which when refined may be produced gasoline, domestic heating oils, diesel fuel, jet fuel and the like. The vapors pass through lines 18' and 18'' controlled by valve **18*a* and through water cooled condenser 19 and into the receiver 20. Valves 18*a* and more particularly 19' may release the gas for use or storage; and more importantly, it controls the pressure on the entire cracking section B of the process; valve 19'' controls the draw off of the pressure distillate which contains the raw gasoline and distillate fuels (unrefined) already referred to as the principal products of the process after refining. The gas pases from receiver 20 through line 19*a* controlled by valve 19' to separator 11*a*, from which it passes to storage through line 11*b* controlled by valve 11*b* which also may control the pressure upon the entire cracking section B of FIG. 1. 11*c* near the bottom of the separator is the means for draining the same. Some distillate is recirculated through pump 21 and line 21 and valve 21'' into the top of the dephlegmator which cools and condenses the heavier portion of the vapors arising therein; and the hot condensate therefrom (referred to as reflux) is circulated through line 22 controlled by valve 22' to join the stream of the heavier and major portion of hot shale oil leaving the bottom of fractionator 8. The combined streams ar then pumped by the high pressure hot oil pump 13 through the heating tubes 14 and into reaction and cracking chamber 16 in the cracking section of the process, to complete the cycle of the process. Lines and valves 22*a* and 22''** if desired for special operation are for draw off use, sampling, etc., or pumping to storage after heat exchange.

Reverting to the producer gas operation to furnish fuel for self-sufficiency and economy of the process in providing fuel for the overall operation. The basis for this is in the first instance the conversion of the fixed carbon in the spent oil shale (amounting to about ⅓ of the latter), and its utilization for fuel. It also serves to clean up the spent shale for the other uses referred to below. In the process the spent shale passes from the retort and is carried by the conveyor (illustrated by the screw or ribbon type), **4*a* while still hot into the gas producer 4. The latter may be defined as a vessel containing a thick layer of subdivided solid fuel, high in carbon, through which air or a mixture of air and steam is passed, with the object of converting the carbon of the spent oil shale to a gaseous fuel, illustrated by lines 4' and 4''**. In this connection, when air is used alone, the fuel is largely carbon monoxide, when steam is added, hydrogen as well as additional carbon monoxide is formed so that the fuel mixture may be carbon monoxide and hydrogen with some nitrogen and carbon dioxide resulting from the reaction. Established principles in connection with both producer gas and water gas and combinations thereof are observed in this connection in addition to the novel uses in the present connection.

It must also be borne in mind that the gas resulting from the retorting of the oil shale itself, as well as the gases from the cracking section of the process offer additional quantities of high BTU fuels in this connection as well as in other parts of the overall process. Also the coke from the cracking process may be used as such or as an additional source of producer gas alone, as well as in admixture with the gas referred to above. Moreover, as already pointed out, all the fuels may be used for the purposes needed both in the process (overall) as well as for refining and steam generation and powder generally to conserve the liquid fuel products of the process and to maximize the yields thereof.

The shale ash is delivered from the gas producer is lump form and ready to use for refilling the excavation from which the oil shale is mined or for some relatively simple further processing of the excess volume (20 to 25%) to make refining agents, e.g., (a) adsorbents (comparable to the same uses as fullers earth) and (b) catalysts for further treatment, as found expedient, of the pressure distillate received from the process to improve the gasoline therefrom as well as other distillates. (However, the distillates are generally chemically treated with sulphuric acid, etc. to produce commercial products.) (c) Another product which may be made from the ash is cement. The basis for all these possibilities is the similarity of composition and structure to the above products e.g., in the case of the adsorbents and catalysts and of cement, some limestone may have to be added. The degree of preparation of the raw ash as it leaves the gas producer is very little as in effect it is already advanced in preparation at that stage. With regard to the flow of the shale ash from the gas producer, it passes through the bottom of the producer 4*a* controlled by element 4*b* and passes over divider e, the major portion passing into spent shale storage for return to the mining excavation from which the oil shale is removed, in the interest of restored ecology.

The combustion gases (after utilizing the heat thereof to produce steam for power or refining, or by heat exchange) in general pass through the stack. The fuel used to heat the cracking tubes may be gases from the retort, producer gas made from the coke produced in the cracking section of the process and/or the cracked gases from the process.

It is noted here, in general, that the pressure on the cracking system or section of the process is substantially the same throughout all parts of the latter and is controlled by suitable valves in the distillate receiver as well as gas release and pressure control by valve on separator. It is also specifically noted that whereas the oil shale retort as well as the fractionator of the retort section A of FIG. 1 are substantially at atmospheric pressure, cracking section B of FIG. 1 are at high pressure generally between about 125 pounds to 250 pounds. Depending upon a number of factors, the pressures for shale oils may vary between 125 and 200 pounds more or less for different operations. It may also be noted that the operation of the cracking section of the process in FIG. 1 section B is essentially the same as that described in FIG. 1B section B in the parent case, taking into account of course the difference in specific features and details shown of each.

With regard to the removal of coke, several methods may be employed which may be briefly described. (1) The oldest and most general method is to suspend a flat cord of steel cable in the reaction or coking chamber and when the latter is full of coke, to remove the same by pulling the cable and the coke from the bottom of the chamber. (2) The hydraulic method employs high pressure water jets to remove the coke after boring a hole through the latter. Another method employs a drill stem to drill the coke mass in various directions disrupting the latter and permitting removal.

Referring to FIGS. 2, 3 and 3A, the notations on the drawings and explanations thereon explain the various elements and the overall principles involved. In general, it is noted that FIG. 2 is a vertical retort, or more correctly, is intended to represent a battery of a number of retorts of the type depicted, all in the same setting and receiving their heat from the same source. It is further noted that the furnace or heating setting in FIGS. 2 and 3 is fire brick or similar ceramic material but the retort 3 itself is iron or steel similar in use to the vertical "cylindrical" type employed in FIG. 1, e.g., as depicted in section A preferably tapered as in FIG. 1C. The general principle of heating in FIGS. 2, 3 and 3A (a cross-section of FIG. 3) is the same as that in FIG. 1 with respect to keeping combustion gases 3 separate in all cases from the oil vapors and hydrocarbon gases 3 (as illustrated in FIG. 1) resulting from the decomposition of the descending oil shale in the vertical retort of FIG. 2, and the same principle applies to the rotary retort (horizontal) of FIG. 3 and FIG. 3A which is a cross-section view of FIG. 3. FIG. 2 and FIG. 3 are similar to each other also with respect to a separate firing chamber 3'*a* interconnected by heating ports or openings 3''*a* to the heating chamber 3', wherein the retorts both vertical in FIG. 2 and horizontal in FIG. 3 are located in both cases. As emphasized, the preferred operation in all cases is that the combustion gases pass through separate channels and not be mixed with the oil vapors and the hydrogen gases.

With special reference to FIGS. 2 and 3, FIG. 2 as explained represents a battery of vertical retorts 3, whereas FIG. 3 is a rotating horizontal retort preferably sloping to include passage and discharge of the oil shale. The latter as explained in connection with FIG. 1 (section A) is fed into hopper 2 with feed mechanism 2*a*, and additionally 2*a'* in the case of FIG. 3, and passes through the retort. The discharge and control mechanism for FIG. 2 is the same as that described in connection with FIG. 1; that in FIG. 3 depends upon the slope and rate of rotation of the horizontal retort. The spent shale is carried out by screw and/or belt conveyor to the gas producer as discussed above and shown as 4*a* and 4*a'* respectively. FIG. 3A as explained above is a cross-section of FIG. 3. The remaining elements and numerals not already referred to in connection with FIGS. 2 and 3 (and 3A) are: line 7 controlled by valve 7' (as in FIG. 1) for passage of oil vapors and hydrocarbons gases to Fractionator 8 (FIG. 1), also line 5 in FIGS. 2 and 3 for passage of combustion gases (7*a* in FIG. 3 is a fan to induce flow which may be used in all cases); special elements shown in FIGS. 3 and 3A are: rotation elements comprising motor and gear mechanism (FIG. 3) and rollers upon which the horizontal retort rests, and receiver Rx and additional elements necessary for spent shale discharge and removal. Special elements, e.g., of the "star type on the inside and movable along the bottom of the retort" (not shown) may be found useful to prevent sticking of the heated oil shale on the inside and assist in removal of the same in connection with heat transfer. The arrangements of FIG. 1 and the other two FIGS. 2 and 3 may be varied with respect to location of the gas producer, etc., or source of heat generally, and the facilities supplied to transport the spent oil shale (shown as 4*a* and 4*a'*) as well as for treatment of the ash as described in connection with FIG 1A. Location of the latter facilities is a matter of choice and convenience.

Regarding yields of the primary products, various assays of the United States oil shales for oil yields, e.g., Green River Formation, show variations in yields of recoverable products for process use, e.g., of 16 to 65 gallons of crude oil per ton of oil shale but may vary on both sides. The deposits to be exploited are those which occur and are available in large amounts of satisfactory crude oil yield, and, of course, a number of other conditions must be considered as heretofore pointed out. A more or less typical oil shale from the Green River Formation (Western United States) may show a yield of about 20 gallons, (½ barrel per ton) and about 2000 cubic feet of permanent gas at a retort temperature between about 800° to 900° F. (more or less) depending upon the time factor. As noted below, higher temperatures may be even more effective especially on capacity. It may also be noted at this point that the overhead distillate from fractionator 8 and/or partial condenser of the retort section A, FIG. 1, may consist of about 25% water containing ammonia and about 75% oil distillate (mainly gasoline) together amounting to less than 20% of the total oil product, the remainder of about 80% which comes from the bottom of the fractionator 8 and passes to the cracking section B of the process in FIG. 8. It is also noted that both the ammonia and the hydrocarbons gases from fractionator 8 are recovered as a by-product. The spent shale was about 84% of the original oil shale and the ash about 61% with about 23% of fixed carbon. The hot oil reflux condensate from the bottom of the fractionator 8, FIG. 1, section A, which is essentially the crude shale oil minus the overhead light distillate fraction from fractionator 8 is pumped into the heating coil of the cracking section and may be heated to a temperature generally of from about 800° to 900° F., more or less, under a pressure of about 125 to 150 pounds, more or less, in this section and discharged into the reaction and/or cracking or coking chambers, recycling the reflux and recovering the overhead products.

The yield of pressure distillate, i.e., which contains the gasoline product, plus other distillate products of the process, in the present example on a non-residuum operation (i.e., running to coke without withdrawing liquid residuum from the chamber, was 82% which on redistillation produced a NEP gasoline yield of 52% and bottoms yield equivalent to combined distillate heating oil, diesel oil, etc. of 24%. The latter could be reduced by further cracking to additional substantial yields of gasoline (if desired) or the heavier distillate used as on the above basis; the yield of gasoline from the oil shale was about 17.2 gallons per ton of oil shale and the heavier oil for heating, diesel and other uses, about 4 gallons per ton. It is noted at this point that the richer shales which have generally shown about 1 barrel per ton or 42 gallons of crude shale oil would produce twice this amount, i.e., 34.4 gallons per ton of gasoline and 8 gallons of heavier oil distillates.

In the type of cracking operation referred to above, namely the non-residuum type, where there is no heavy residual liquid product which is the preferred type since all of the liquid products are distillates in the form in greatest demand and use. The residue coke product withdrawn from the reaction chamber, about 18% by weight of the oil charge, is an excellent low ash fuel readily converted to producer gas as such (or enriched by the use of steam during the operation of the gas producer) as well as for other commercial uses; and the hydrocarbon cracked gas from the process (a rich gas averaging about 12 to 13 hundred BTU per cubic foot), is about 7% by weight of the oil leaving the bottom of the fractionator 8 (FIG. 1, section A). It is estimated that there is more than ample fuel available from the by-products in all of the above operations including as stated about 25% carbon in the spent shale, recovered by conversion to producer gas; the coke from the cracking operation referred to above which may be recovered to be used as producer gas or used as such, i.e., as a solid low ash fuel; and the hydrocarbon gases from the retorting and cracking operations to take care of the process operations as well as fuel requirements for steam and power generation, refining operations and, in general, all fuel requirements for all purposes. The cracked gases may be used as such or mixed with the producer gas. It is noted that if heavy residual oil is for any reason a desired product, in addition to the distillates, slight modification in operation as the addition of a flash drum operated at lower pressure would facilitate such operation.

It is to be especially noted as pointed out heretofore that heat recovery generally is important in connection with the present invention and operation because of the special nature of the raw material (oil shale) since it must be processed relatively near the mining location to avoid shipping costs and the fuel employed in connection with all process and refining operations as well as for steam and power, etc., as emphasized above, must be generally of a by-product nature. It is also to be reemphasized that heat recovery from hot combustion gases from both the retorting (A) and cracking (B) sections as well as all other heat exchange operations should be utilized.

With regard to the refining of the distillate from the retort section, for example, in FIG. 1, FIG. 1A, etc. and the pressure distillate from the cracking section entirely satisfactory marketable products may be produced including the gasoline and other distillates, in spite of off-color appearance and offensive odor of the raw distillate (and some adverse opinion apparently); it may be definitely stated that a water white stable gasoline of sweet odor, meeting all commercial specifications may be obtained by refining the pressure distillate using a modification of the sulphuric acid method; employing either batch or continuous operations and equipment. Briefly, the method devised and tested in the present invention is as follows. The cracked shale oil distillate (to which may also be added the light overhead oil distillate from the retort section, but preferably separately as described below) is water washed and treated with strong sodium hydroxide solution containing lead oxide $Pb_3O_4$ dissolved therein, referred to as "Plumbite" solution. A short water wash follows the drawing of the plumbite sludge. After settling, the distillate is given a preliminary treatment of about 1 pound sulphuric acid per barrel of distillate employing a somewhat dilute acid at this state. The main acid treatment of about 5 to 7 pounds (1.84 spG acid) per barrel of distillate follows and after drawing the acid sludge from the latter, the cracked distillate is water washed, the water drawn off, and the oil then treated with a solution of sodium hydroxide or plumbite solution. The distillate is finally distilled in the presence of sufficient steam to control the water white color of the overhead gasoline product and the quality of the heavier distillate. If the gasoline distillate product at this stage is unstable and tends to go off color on standing, the latter may be remedied by treating in the first instance with a light dilute sodium hydroxide wash followed by treatment with a small percentage of fullers earth (or with the treating earth made from the oil shale ash as described herein). The gasoline or light oil distillate from the retort section A of the process may be withdrawn from the receiver separately from the water and given a light acid treatment followed (after water washing and drawing the sludge) by a light caustic treatment and water wash, and then combined with the treated pressure distillate and proceeding with distillation as described above.

The gasoline produced by cracking shale oil on analysis showed relatively high aromatic hydrocarbon equivalent which in comparison with petroleum cracked distillate from a wide variety of sources proved to be amenable to current methods of blending to obtain a good antiknock value, suitable in all respects for general motor fuel use, the conclusion being that it meets all requirements in this respect.

In another cracking operation for comparison producing liquid residuum using a comparable topped cracked shale oil crude Sp.G.O. 8756 (with a pressure of about 150 pounds and temperature of about 820° F.), the yield of pressure distillate was about 56% with a total yield based on the conversion of shale oil of 50% gasoline. It is noted that the incondensible gas yield on the nonresiduum process is about 7% making coke only as a residue, whereas in making a liquid residuum, it drops to between 4 and 5% of the charge. The heavy residual oil withdrawn from the reaction chamber was 35.4% and the coke produced about 4.5%. The flashing while hot under a reduced pressure or redistillation of the residual heavy oil would produce an overhead distillate and heavy liquid residue or may be run to coke. This is considered a less desirable operation although within the scope of the invention.

In view of the great importance of the retorting process which is an integral part of the overall process in treating oil shales to produce the products described herein, it would appear desirable to point out a number of important factors bearing on this phase of the operation, not only with respect to yields of oil vapors which is reflected in the quality and amount of condensed heavier oil product collected in and withdrawn from the bottom of the fractionator and partial condenser element 8 in FIG. 1 (and FIG. 1A), but also on the capacity and throughput of the process. This subject, e.g., the effect of temperature and time of heating upon yield, etc. has received some attention by workers in the field, and has been noted by others on different types of oil shale. The overall conclusion by applicant is that a rapid rate of producing the oil vapors at somewhat higher temperatures is desirable from the view point of capacity as well as yield. In one case an oil yield of about 45 gallons per ton of shale in less than two hours at a temperature of about 970° F. was observed whereas at about 870° F. the time required to yield 42 gallons per ton was about four hours. It is also noteworthy that retorting at 850° F. drops the yield still further. In this particular case apparently also in all of these cases the shale was partially reduced down to about ¼ inch in size which indicates a wider range in this respect. It is expected, therefore, that quick retorting, e.g., at between 950° F. and 1000° F. or higher (i.e., at higher temperatures and shorter periods of time) could result in larger throughputs or capacity and less exposure of the oil vapors at high temperatures; also there is the probability that a considerable range in these respects without adverse effects on the distillate products in the cracking (or B section of the process) all of which is an important factor in the economy of high capacity oil shale operations. There is, however, some likelihood of higher gas yields and somewhat less distillate yields, although this would be offset by the shorter time factor. However, from the data to date this type of operation appears very promising especially in connection with much higher capacities of the retort section as a result of the operation referred to above. Moreover, the various types and sizes of oil shale retorts proposed by me (see drawings) should without doubt be conducive to greatly improved result in this respect. It is also noted that the use of steam in the retort within limits is helpful both to rapid retorting and higher yields especially in connection with the novel design of the several types of retorts disclosed by me as well as conditions of operation including the pretreatment of the oil shale disclosed herein. The operations connected therewith all lead to an industrialized oil shale industry commensurate with the modern petroleum industry. It is noted in the above connection that capacities of the cracking section of the process are generally considerably greater than the retort section on a unit basis. However, the above improvement will tend to equalize this. It may also be further noted that as a measure of economy, the use of the oil shales fines, within limits, together with some larger pieces of oil shale tend to increase the quantity of oil proportionately and apparently reduces time of retorting. However, there is some evidence that too great a proportion of fines may reduce the overall yields of oil. Moreover, the fines may be employed as fuel if desired, e.g., in connection with the retorts shown in FIGS. 2, 3 and 3A much like powdered coal and the latter may likewise be employed if available as well as powdered coke (all however on a selective basis), thus conserving the gaseous fuels for other uses. In any event, the sources of by-product processing fuel for all needs including refining process production and other uses appears assured.

The immediate foregoing relates to a number of improvements in the operation of the retort section of the process generally. It is my intention similarly to make use of, as set forth here, certain improvements in the operation of the cracking section B in FIG. 1 (as well as FIG. 1B of the parent case) in addition to those already discussed as well as in refining the liquid product of the section, e.g., I may take the major portion (or all) of the reflux from the dephlegmator 18 of the section B, FIG. 1, and pass it to a second heating coil in a separate furnace setting at a somewhat higher temperature than in the first furnace setting, heated for example as high as 970° F. and topped crude shale oil from the bottom of fractionator 8, section A, FIG. 1, is cracked in the first heating coil already described, alone or preferably in admixture with a portion of the reflux at a higher range of temperatures, e.g., about 825° to 935° F. The arrangement of the reaction chambers may be the same as shown in FIG. 1B in the parent case. Also it may be noted that in general the same pressure is maintained throughout the cracking section B except where liquid residuum is withdrawn and flashed at lower pressure to recover additional distillate. What applies to the cracking section of FIG. 1 also applies to FIG. 1B of the parent application in connection with the above; and in general, the latter is a more detailed description of the operation of the process.

It also may be noted in connection with FIG. 1, section B, that the vapors, etc. in the line indicated as 18B and valve **18*c*** may be passed to alternate treatments, e.g., (a) vapor phase refining of the pressure or cracked distillate by various methods relating to treatment of the vapors to refine the same, e.g., passing the vapors through fullers earth or similar refining clay for example, the refining earth made from the spent shale as described above. Alternately, the heavier portions of the overhead distillate from the dephlegmator or fractionator of the cracking section may be separated from the light oil vapors by passing the vapors through a heat exchanger or partial condenser may be subjected to catalytic cracking employing a suitable catalyst, e.g., that made from the spent shale ash and the use of a modification of the fixed bed or fluid catalyst or moving bed process or other system generally operated at temperatures of 850° to 1000° F. (more or less). It is thus clear that many variations of treating the distillate products may be employed, for example, heat and power which might otherwise be wasted or suitable available substitutes found in other locations are utilized and most important the need for the use of valuable liquid products of the process as fuel is avoided. The question of heat economy in any event thus becomes an important question.

As set forth above generally, in connection with the operation, my novel unitary continuous process, the topped shale oil from the retort section A is passed directly, while still hot, to the cracking section B and this is the preferred operation as described above. It is also emphasized that in order to maximize production capacity, it has been found desirable heretofore to have a large number of process systems comprised or made up of sections A and B as described. In order to obtain maximum capacity, each battery of retorts in section A are generally balanced from the viewpoint of capacity or throughput, by the cracking section B and the present improvements greatly assist this arrangement.

It may be noted in passing that the distillate oil products made according to my process are suitable in all respects as raw material for the petrochemical industry in fact as well as in name.

There are several additional questions in connection with my novel process for the treatment of oil shale to produce distillate fuel products, as hereinbefore described, which should be emphasized. One of them referred to above is the desirability, if not necessity, mainly from an economic viewpoint, to carry out the operations of my process in the vicinity where the oil shale is mined, because of the cost and impracticability of transportation, etc., the probable use of the oil shale ash (and/or some of the spent shale) as refil material and other important reasons rather than to locations otherwise more suitable for processing. However, the fuel distillate products of my process may be piped to a conveniently located refinery for final treatment into marketable products as described.

The recovery of heat relates to either or both sections A and B of my process, many examples of which have already been set forth above; and others which may be utilized. I have already pointed out a number of such sources of heat and valuable uses of otherwise waste heat which should suffice as examples thereof.

Having described my invention and modifications thereof in considerable detail, it is noted that it should not be limited thereby, but should be interpreted in accordance with the broad scope and spirit of the same; as well as for its great importance both to our present and prospective future energy situation; and to the future independence of the nation in respect thereto.

I claim:

1. A continuous process for removing a substantial amount of the water present in oil shale prior to retorting the same to facilitate the rate of recovery of the oil therefrom in the retorting step of the process and to substantially increase the capacity of the retorting step in the process and improve the overall efficiency thereof; which comprises subjecting the said oil shale in subdivided form to indirect heat treatment in a partial dehydration step conducted at a temperature of up to 650° F., said partial dehydration step being conducted by passing said oil shale into a vertical retort equipped with hollow shelves opening into said vertical retort through which hollow shelves hot combustion gases are passed to partially dehydrate said oil shale, moving said oil shale progressively downward onto and over said shelves wherein it is indirectly heated by said hot gases passing there through, said partial dehydration being conducted for a sufficient time to remove substantial to major amounts of free and combined water from the oil shale and considerable amounts of oil distillate and thereafter passing the heated partially dehydrated oil shale to a retorting step for further heat treatment at a temperature of about 850° F. to about 1,000° F., fractionating the vapors from the retorting step wherein there is removed a light overhead product comprising vapors of low boiling hydrocarbons, water, hydrocarbon gases and ammonia and wherein heavier conversion oil product from the oil shale are condensed and separated as a liquid for further treatment and use.

2. A process as described in claim 1 wherein waste hot gases from the retorting step are used to indirectly heat the partial dehydration step of the process.

3. A process as described in claim 1 wherein the oil shale undergoing treatment in the retorting step of the process is heated in a rotating substantially horizontal cylindrical vessel.

4. A process as described in claim 1 wherein the oil shale undergoing treatment in the retorting step of the process is heated in a rotating substantially horizontal cylindrical vessel.

* * * * *